US008800453B2

(12) United States Patent
Gaiguant et al.

(10) Patent No.: US 8,800,453 B2
(45) Date of Patent: Aug. 12, 2014

(54) ARTICULATED COUPLING BETWEEN A FIRST CAR AND A SECOND CAR OF A VEHICLE, ESPECIALLY A RAILWAY VEHICLE

(75) Inventors: Jean-Claude Gaiguant, Chatelaillon Plage (FR); Isabelle Guilloteau, Aytre (FR)

(73) Assignee: ALSTOM Transport Technologies, Levallois-Perret (FR)

( * ) Notice: Subject to any disclaimer, the term of this patent is extended or adjusted under 35 U.S.C. 154(b) by 0 days.

(21) Appl. No.: 12/799,931

(22) Filed: May 5, 2010

(65) Prior Publication Data

US 2010/0326944 A1 Dec. 30, 2010

(30) Foreign Application Priority Data

May 6, 2009 (FR) ..... 09 53009

(51) Int. Cl.
*B60D 5/00* (2006.01)
*B61D 17/20* (2006.01)

(52) U.S. Cl.
USPC ..... 105/8.1; 213/220

(58) Field of Classification Search
USPC ..... 105/8.1; 213/7, 62 R, 64, 75 R, 220, 221
See application file for complete search history.

(56) References Cited

U.S. PATENT DOCUMENTS

| | | | | |
|---|---|---|---|---|
| 2,051,958 | A | 8/1936 | Madison | |
| 4,942,824 | A | 7/1990 | Cros | |
| 5,377,597 | A | 1/1995 | Richter et al. | |
| 5,456,185 | A | 10/1995 | Rother et al. | |
| 5,615,786 | A | 4/1997 | Hoyon et al. | |
| 6,234,702 | B1 | 5/2001 | Jeunehomme et al. | |
| 6,499,613 | B1 * | 12/2002 | Grau et al. | 213/7 |

FOREIGN PATENT DOCUMENTS

| | | |
|---|---|---|
| DE | 43 05 614 | 8/1994 |
| EP | 0 562 598 | 9/1993 |
| EP | 0 567 950 | 11/1993 |
| EP | 0 906 860 | 4/1999 |
| EP | 1 312 527 | 5/2003 |
| FR | 0 343 482 | 11/1989 |
| FR | 2 716 149 | 8/1995 |
| FR | 2 879 549 | 6/2006 |
| WO | WO 2005/023619 | 3/2005 |

* cited by examiner

*Primary Examiner* — Zachary Kuhfuss

(74) *Attorney, Agent, or Firm* — Davidson, Davidson & Kappel, LLC

(57) ABSTRACT

The invention relates to an articulated coupling between a first car (3) and a second car of a vehicle, especially a railway vehicle, having at least two cars, said articulated coupling including a first element (33) capable of being connected to said first car (3) and a second element (35) capable of being connected to said second car, a device for moving said second element (35) in translation relative to said first element (33) in the event of an impact, and an energy absorber capable of being arranged between said first (3) and second (19) cars. The energy absorber is arranged between said first (33) and second (35) elements, and in the first element (33) is designed to allow persons to pass between said first car (3) and said second car.

20 Claims, 3 Drawing Sheets

ARTICULATED COUPLING BETWEEN A FIRST CAR AND A SECOND CAR OF A VEHICLE, ESPECIALLY A RAILWAY VEHICLE

This claims the benefit of French Patent Application FR 09530009, filed May 6, 2009 and hereby incorporated by reference herein.

FIELD OF THE INVENTION

The present invention relates to an articulated coupling between a first car and a second car of a vehicle, especially a railway vehicle, having at least two cars, said articulated coupling being of the type comprising a first element capable of being connected to said first car and a second element capable of being connected to said second car, means for moving said second element in translation relative to said first element in the event of an impact, and energy absorbing means capable of being arranged between said first and second cars.

BACKGROUND

Document FR 2 716 149 describes such an articulated coupling, the purpose of which is to protect the structures of railway vehicles and the connecting devices between the vehicles in the event of minor collisions.

Such an articulated coupling is used in particular when it is mounted between two cars of a railway vehicle each having two decks, because such double-deck cars have a greater weight as compared with cars having only a single deck.

For railway vehicles having only single-deck cars, a different impact absorbing device is used.

Document FR 2 879 549 describes an exemplary embodiment of such a device, which is arranged at the front of the railway vehicle and not between the cars.

Such a device is satisfactory for railway vehicles having a small number of cars, for example up to eleven cars.

However, for railway vehicles having a larger number of cars, for example twenty cars or more, energy absorbing devices provided at the front of the vehicles are no longer sufficient.

Attempts have therefore been made to add energy absorbing devices between the cars of such vehicles, in order to dampen impacts further in the event of a collision.

The articulated couplings described in document FR 2 716 149 are not suitable for arrangement between two cars having a single deck because they are bulky. In particular, they require the entire form of the devices that allow persons to pass from one car to another to be changed.

The object of the invention was, therefore, to produce an articulated coupling between two cars whose space requirement would be substantially identical to that of existing articulated couplings between two cars each having a single deck, and which would also include means for absorbing impacts in the event of a collision.

SUMMARY OF THE INVENTION

It is an object of the present invention to provide a coupling of the above-mentioned type, in which the energy absorbing means are arranged between said first and second elements, and in which said first element is designed to allow persons to pass between said first car and said second car.

Such an arrangement of the energy absorbing means allows the space requirement of the articulated coupling to be reduced and, combined with such a design of the first element, it allows a more compact form than those known from the prior art.

The articulated coupling according to the invention can also have the following features, taken separately or in combination:

said first element comprises means forming a slideway, on which means said second element is mounted;

the articulated coupling comprises means for holding the second element relative to the first element, said means preventing translation of said second element relative to said first element, said means being constructed to break in the event of an impact in order to allow the second element to move in translation relative to the first element;

the energy absorbing means are interposed between one end of said second element and said first element, the energy absorbing means being constructed to deform when said second element moves in translation relative to the first element;

the energy absorbing means comprise one or more of the following elements:

mechanical resilient compression means;

a compressible material capable of reversible resilient deformation, at least up to a certain threshold stress;

a compressible material capable of permanent plastic deformation;

one or more components capable of permanent plastic deformation by crushing and/or bending; or a combination of elements from the above elements;

the energy absorbing means are fixed to the second element or to the first element or to both the second and the first element;

said first element comprises means for fixing it to said first car;

said first element has a central portion, which comprises said means forming a slideway and is capable of forming a gangway between said two cars, and two lateral portions, which are capable of being fixed to the lateral walls of a corridor and are provided between said two cars;

said first element is produced in one piece;

said second element comprises means for receiving a ball-and-socket joint, which serves to hold the articulated coupling on the second car and effects pivoting between said two cars in order to ensure that they negotiate curves;

said second element is produced in one piece.

BRIEF DESCRIPTION OF THE DRAWINGS

Other aspects and advantages of the invention will become apparent upon reading the following description, which is given by way of example and with reference to the accompanying drawings, in which.

DETAILED DESCRIPTION

Figure 1:
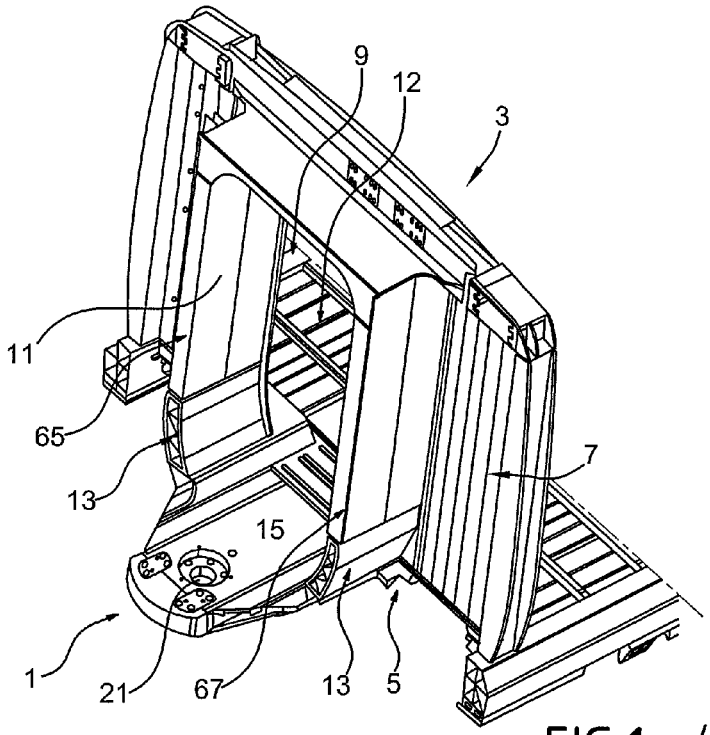
FIG.1 (PRIOR ART)
FIG. 1 is a perspective view of part of a first railway vehicle car, at the end of which there is mounted an articulated coupling according to the prior art.

At the origin of the invention was the attempt to replace a device 1 for articulated coupling between two railway vehicle cars, shown in FIG. 1, fixed to the end of one car 3, by another device according to the invention.

The other device, according to the invention, must not only provide the same functions of articulated coupling between two cars and passage for passengers; it must also provide a damping function in the event of an impact.

The device according to the invention, which is also referred to as the articulated coupling in the following description, must also not be more bulky than the device 1 shown in FIG. 1 so that, in practice, the device 1 can be changed for an articulated coupling according to the invention without having to change the form of the end 5 of the car 3.

The ends 5 of the cars have a wall 7 through which there passes an intercommunication passage 9 of such a height that a man of average height is able to stand up therein.

Around the passage 9 there is fixed a frame 11, which forms part of a corridor 12 between two cars.

The device 1 of the prior art is designed to be fixed at least partially to the frame 11, at the bottom part of the passage 9.

To that end, the device 1 has two substantially symmetrical lateral portions 13, each of which is designed to be fixed to an element of the frame 11, on either side of the corridor.

The device 1 also has a substantially flat central portion 15 of such a form that it can be accommodated in a receiver 17 provided at the end of a second car 19 and allow a person to pass between the car 3 and the car 19.

The central portion 15 of the device 1 also has a through-opening 21 which is capable of cooperating with an opening 23 provided in the receiver 17 of the second vehicle 19, when the device 1 is positioned in the receiver 17.

A ball-and-socket joint is inserted into the openings 21 and 23 when the device 1 is mounted in the receiver 17 of the second vehicle 19 in order to provide articulated coupling between the cars 3 and 19.

The receiver 17 has the shape of a trapezoid 25 in order to permit slight pivoting of the device 1 between two edges 27 and 29 of the receiver 17 about the ball-and-socket joint, for example when the railway vehicle, including the cars 3 and 19, comes to a bend, so that the cars negotiate the curve.

Figure 3:
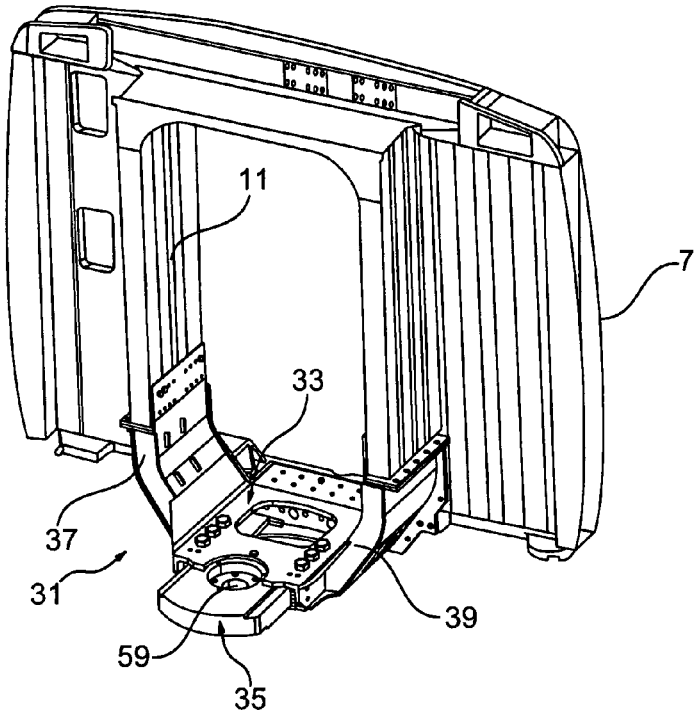
FIG. 3 is a perspective view of an articulated coupling according to the invention, mounted at the end of a first car.

FIG. 3 shows an example of an articulated coupling 31 according to the invention, which is capable of replacing a device 1 as described above.

The articulated coupling 31 is fixed at least partially to the frame 11 of a vehicle 3, like the device 1.

Only the wall 7 of the car 3 has been shown in FIG. 3, so as to facilitate understanding thereof.

Figure 2:
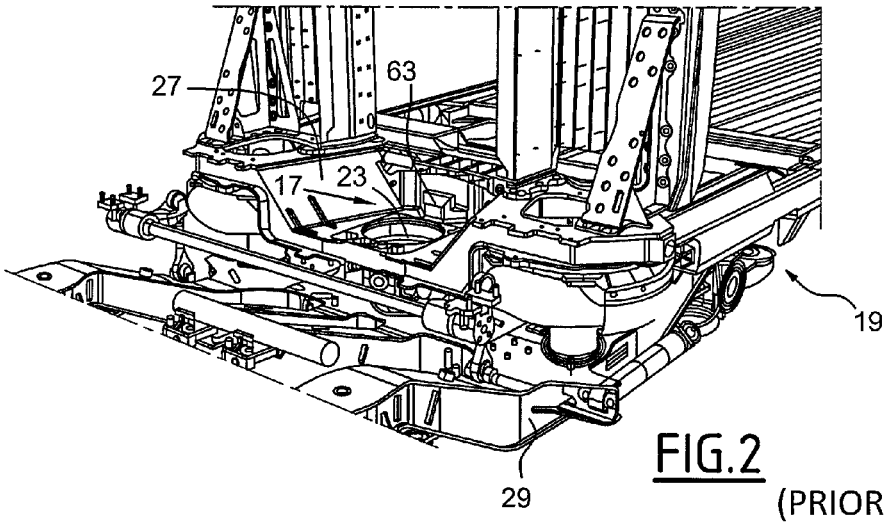
FIG.2 (PRIOR ART)
FIG. 2 is a perspective view of part of a second railway vehicle car, the conventional articulated coupling of FIG. 1 being mounted at the end of the second car.

The articulated coupling 31 comprises a first element 33 having means for connection to the car 3, which is shown partially in FIGS. 1 to 3, and in particular to the frame 11 of the car 3.

The first element 33 is produced in one piece, for example of steel, aluminium, a composite material or the like.

Producing the element in one piece from steel provides the articulated coupling with physical properties such that it is able to withstand especially compressive forces of substantially 1500 kN and tensile forces of substantially 1000 kN and that it has a vertical load resistance of substantially 1.3 CE.

Figure 5:
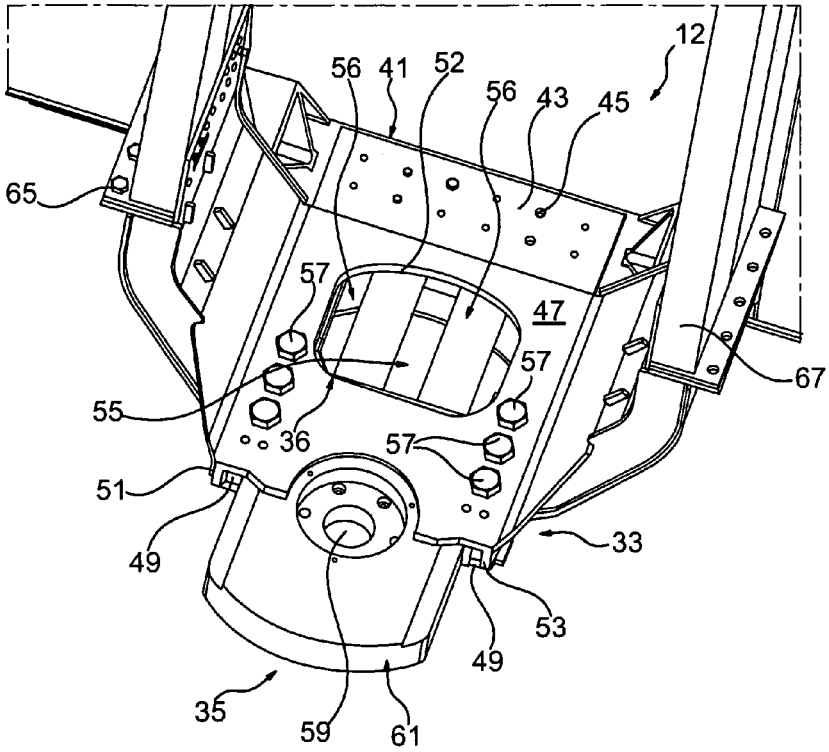
FIG. 5 is a top perspective view of the articulated coupling of FIGS. 3 and 4 and shows in particular the means for coupling said articulated coupling to one end of the first car.

As is shown in FIG. 5, the first element 33 comprises, more particularly, a central portion 36, which is capable of forming a gangway between the two cars 3 and 19, and two lateral portions 37 and 39, which are capable of being fixed to the lateral walls of an intercommunication corridor provided between two cars.

The central portion 36 is shown in particular in FIG. 5.

It additionally has, at one of its ends, means 41 for fixing it to the end of the car 3.

The fixing means 41 comprise, for example, a plate 43 which projects from an edge of the central portion 36 and has through-holes 45 capable of receiving fastening bolts, rivets and shear pins.

The central portion 36 is hollow and is substantially U-shaped in cross-section. Accordingly, it has an upper wall 47, two lateral walls 51 and 53, and two bands 49, parallel to the upper wall 47, which each extend from one of the lateral walls 51, 53 and form a shoulder facing the inside of the central portion 36. Finally, it has a rear wall 52 connecting the lateral walls 51 and 53.

Such a configuration allows the first element 33 to serve as a slideway.

The plate 43 is substantially a continuation of the upper wall 47.

The articulated coupling 31 also comprises a second element 35 which has means for connection to the second car 19, shown in FIG. 2.

The upper wall 47 has a through-opening 55 which especially allows energy absorbing means 56 to be fixed between the first 33 and second 35 elements. Such means are known per se to the person skilled in the art and are, for example, blades associated with bolts 57, as described in patent application FR 2 716 149, or related U.S. Pat. No. 5,615,786, hereby incorporated by reference herein.

The upper wall 47 is substantially flat in order to support a plate forming a floor, allowing persons to move onto the central portion 36.

The second element 35 has an outer shape which is complementary to the inner shape of the central portion 36, so that it is inserted into the portion 36, between the upper wall 47 and the two bands 49, and is able to slide in the central portion 36.

The first element 33 will be called the slideway 33 and the second element 35 will be called the slider 35 in the following description.

When produced in that manner, the slideway 33 and the slider 35 move in translation relative to one another in the event of an impact.

The device comprises means for holding the slider 35 in the slideway 33 under normal use conditions, so as to prevent movement of the slider 35 in the slideway 33 during normal operation of the railway vehicle. In the event of an impact of a force that exceeds a given threshold, the holding means are constructed to break in order to free the slider 35 and allow it to move in the slideway 33 so that the energy absorbing means 56 are able to fulfil their function. The holding means are formed, for example, by bolts 57 which pass through the slideway from the upper wall 47 to the bands 49, passing through the slider 35. Before an impact, the bolts 57 serve to hold the slider 35 in position in the slideway 33. In the event of an impact, the bolts 57 break, which frees the slider 35, which is thus able to move in the slideway 33.

In addition, the energy absorbing means 56 are interposed between one end of the slider 35 and the rear wall 52 of the slideway 33. The absorbing means 56 can be of any suitable type. Accordingly, by way of example, the absorbing means are:

mechanical resilient compression means, such as one or more associated springs;

a compressible material capable of reversible resilient deformation, at least up to a certain threshold stress, such as a honeycomb material of the foam type, such as a polyurethane foam, for example;

a compressible material capable of permanent plastic deformation, such as a honeycomb material of the foam type, such as polyurethane foams;

one or more components, especially made of plastics material, which are capable of permanent plastic deformation by crushing and/or bending, for example a component in the form of a bellows; or a combination of elements from the elements described above.

The energy absorbing means 56 are fixed to the slider 35 or to the slideway 33 or to both the slider 35 and the slideway 33. For example, the energy absorbing means 56 are arranged at one end of the slider 35 and abut the rear wall 52 of the slideway 33.

Before an impact, the slider 35 is held in position in the slideway 33 by the bolts 57, which are calibrated for shearing.

In the event of an impact, the bolts 57 break or are sheared off, and the slider 35 moves in the slideway towards the rear wall 52 of the slideway 33. Because the energy absorbing means 56 are arranged between the end of the slider 35 and the rear wall 52 of the slideway 33, movement of the slider 35 causes the energy absorbing means 56 to be crushed between the end of the slider 35 and the rear wall 52, which allows some of the energy due to the impact to be absorbed.

Figure 6:
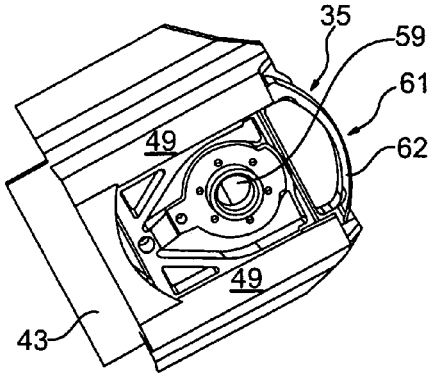
FIG. 6 is a bottom view of the articulated coupling according to the invention after an impact.
Figure 7:
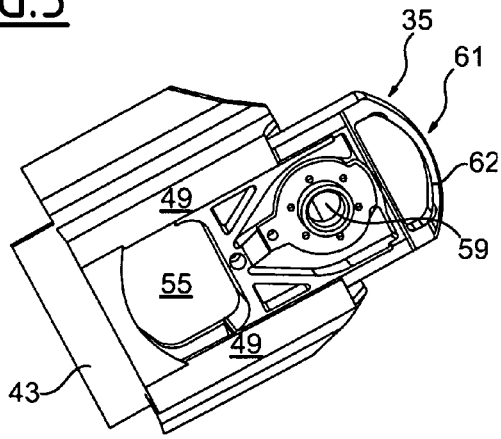
FIG. 7 is a bottom view of the articulated coupling according to the invention before an impact.

FIGS. 6 and 7 show the position of the slider 35 in the slideway 33 after an impact and before an impact, respectively.

The travel of the slider 35 in the slideway 33 is substantially 300 mm.

As will be seen in particular in FIGS. 5, 6 and 7, the slider 35 has a substantially circular opening 59 which allows a ball-and-socket joint (not shown) to be accommodated, ensuring that the articulated coupling is held on the second car 19, as shown in FIG. 2.

As explained above, the ball-and-socket joint permits pivoting between the two cars 3 and 19 in order to ensure that they negotiate curves.

The slider 35 also has at its free end 61 (that is to say the end on which the energy absorbing means 56 do not rest) means 62 for attaching it to a portion of the end of the second car 19 (see in particular FIGS. 2, 6 and 7).

The attaching means 62 are produced, for example, in the form of a shoulder 62 which engages behind a member 63 forming a hook, said member 63 forming the above-mentioned end portion of the second car 19, which is shown in particular in FIG. 2.

Figure 4:
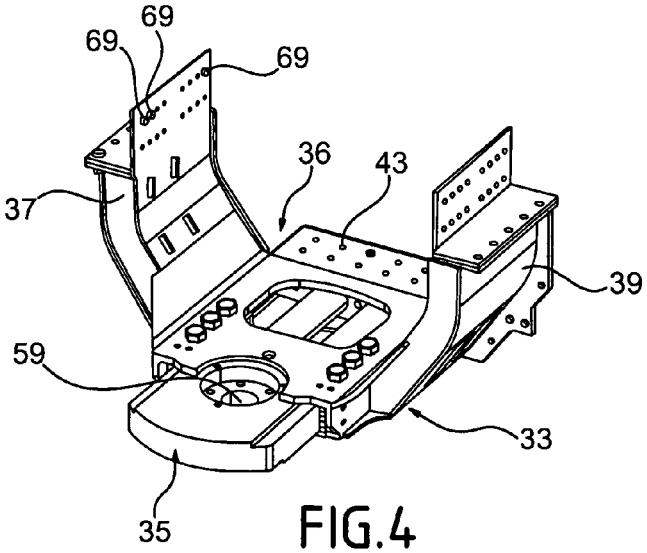
FIG. 4 is a perspective view of the articulated coupling of FIG. 3 on its own.

The two lateral portions 37 and 39 of the articulated coupling, which are shown especially in FIGS. 4 and 5, each have a curved shape, connecting the lateral edges 51 and 53 of the slideway 33 to the lateral walls 65 and 67 of the corridor 12, respectively.

Each of the lateral portions 37 and 39 is fixed to a respective lateral wall 65 and 67 by bolts 69 and rivets (see in particular FIGS. 4 and 5).

To that end, each end of the lateral portions 37 and 39 has a shape which is capable of matching the shape of the walls 65 and 67, so that each end of the lateral portions 37 and 39 is flattened against each wall 65 and 67, respectively.

Each end of the lateral portions 37 and 39 also has through-holes enabling them to be fixed by means of bolts 69 and rivets.

The surplus weight resulting from the replacement of the devices 1 by articulated couplings as described above is substantially 430 kg over the entirety of the railway vehicle, which does not impair (or impairs only slightly) the performances of the railway vehicles for which such articulated couplings are intended.

When produced in that manner, the articulated coupling according to the invention has a space requirement which is substantially identical to that of a device 1 which it is to replace. The articulated coupling can be fitted between each car of a railway vehicle or between certain cars only, depending on the required absorption performances.

Such an articulated coupling allows some of the energy due to an impact to be absorbed effectively, even in the case of a long articulated railway vehicle having, for example, thirteen cars or more.

It will be understood from the preceding description how the invention enables the stated objects to be achieved.

It will, however, be understood that the invention is not limited to the embodiment specifically described and can be extended to other variants which comply with its definition.

What is claimed is:

1. An assembly of an articulated coupling between a first car and a second car of a vehicle, especially a railway vehicle, having at least two cars, and a longitudinal corridor between the first car and second car, the assembly comprising:

a first element connected to the first car, the first element having a central portion, two lateral portions extending laterally from lateral edges of the central portion, and a connector located at one of the ends of the first element for fixing the first element to an end of the first car, the central portion being a slideway and forming a gangway between the two cars, the two lateral portions fixed to the lateral walls of the corridor and provided between the first and second cars, the first element allowing persons to pass between the first car and the second car;

a second element connected to the second car, the second element being mounted on the slideway and having an outer shape which is complementary to an inner shape of the central portion, the second element being configured to be inserted longitudinally into the central portion towards the first car for mounting the second element on the slideway, the second element being designed to move in translation relative to the first element in the event of an impact, and an energy absorber arranged between the first and second cars, the energy absorber being arranged between the first and second elements.

2. The assembly as recited in claim 1, further comprising a holder for holding the second element relative to the first element, the holder preventing translation of the second element relative to the first element, the holder being constructed to break in the event of an impact in order to allow the second element to move in translation relative to the first element.

3. The assembly as recited in claim 1, wherein the energy absorber is interposed between one end of the second element and the first element, the energy absorber being constructed to deform when the second element moves in translation relative to the first element.

4. The assembly as recited in claim 1, wherein the energy absorber includes at least one of the following:

a mechanical resilient compressor;

a compressible material capable of reversible resilient deformation, at least up to a certain threshold stress;

a compressible material capable of permanent plastic deformation; or at least one component capable of permanent plastic deformation by crushing and/or bending.

5. The assembly as recited in claim 4, wherein the energy absorber is fixed to the second element or to the first element or to both the second and the first elements.

6. The railway vehicle as recited in claim 4, wherein the energy absorber includes a mechanical resilient compressor that is a spring.

7. The assembly as recited in claim 1, wherein the first element includes a fixing device for fixing the first element to the first car.

8. The assembly as recited in claim 1, wherein the first element is produced in one piece.

9. The assembly as recited in claim 1, wherein the second element comprises a receiver to hold the articulated coupling on the second car and effects pivoting between the first and second cars in order to ensure that the first and second cars negotiate curves.

10. The assembly as recited in claim 1, wherein the second element is produced in one piece.

11. A railway vehicle having the first and second cars connected together by an assembly as recited in claim 1,

12. The railway vehicle as recited in claim 11, wherein the vehicle has thirteen cars or more, the assembly or a further assembly the same as the assembly being arranged between each car or between some of the cars.

13. The railway vehicle as recited in claim 1, wherein the connector is a plate.

14. The assembly as recited in claim 1, wherein the central portion is hollow and substantially U-shaped in cross section.

15. The assembly as recited in claim 1, wherein the central portion includes an upper wall and two lateral walls.

16. The assembly as recited in claim 15, wherein the central portion includes a rear wall connecting the two lateral walls.

17. An articulated coupling assembly for a railway vehicle having a plurality of cars including a first car and at least a second car and a corridor for passengers to transfer between longitudinally connecting the first car and the second car, the articulated coupling assembly comprising:

a first element connected to the first car, the first element including a central portion forming a gangway of the corridor;

a second element connected to the second car, the second element connected to the first element via the central portion, the second element being fixed to the first element during normal operating conditions; and an energy absorber arranged between the first and second elements for absorbing a force that exceeds a given threshold, the second element designed to move in translation relative to the first element, the central portion designed to receive the second element in an opening therein, in the event of an impact of force that exceeds the given threshold so the energy absorber can absorb the force of the impact, the second element being configured to be inserted longitudinally into the central portion towards the first car for mounting the second element on the slideway.

18. The articulated coupling assembly as recited in claim 17, wherein the second element has an outer shape complementary to an inner shape of the central portion.

19. The articulated coupling as recited in claim 17, further comprising bolts fixedly connecting the second element to the first element, the bolts designed to break in the event of an impact of a force that exceeds the given threshold thereby releasing the second element.

20. The assembly as recited in claim 17, wherein the energy absorber deforms when the second element moves in translation relative to the first element.

* * * * *